United States Patent [19]

Alexandrov et al.

[11] 4,263,241

[45] Apr. 21, 1981

[54] METHOD FOR PRODUCTION OF FIBROUS SHEET MATERIAL AND APPARATUS FOR CARRYING OUT THE SAME

[76] Inventors: Vyacheslav S. Alexandrov, ulitsa S. Kovalevskoi, 7, korpus 5, kv. 66; Alexandr E. Guschin, Kovensky pereulok, 13, kv. 18; Rudolf V. Zavodov, ulitsa D. Bednogo, 22/2, kv. 113; Elena I. Zhukova, prospekt M. Toreza, 92, kv. 25; Alexandr A. Ivanov, Krasnoselsky raion, Fabrichny poselok, 5; Tatyana S. Fofanova, Serebristy bulvar, 18, korpus 2, kv. 237; Evgeny I. Mikhailov, prospekt Slavy, 16, kv. 270; Ivan M. Dianov, ulitsa Zverinskaya, 17-a, kv. 9; Pavel M. Luzin, Institutsky proezd, 9, kv. 68; Igor A. Sergeev, prospekt Stachek, 27, kv. 8; Lidia A. Pankratova, ulitsa Ryleeva, 17, kv. 17; Vera E. Krylova, prospekt Slavy, 2, korpus 2, kv. 41; Semen A. Leibenzon, Srednaya Podyacheskaya ulitsa, 15, kv. 1, all of Leningrad, U.S.S.R.

[21] Appl. No.: 957,478

[22] Filed: Nov. 3, 1978

[51] Int. Cl.[3] ..... D04H 1/20
[52] U.S. Cl. ..... 264/121
[58] Field of Search ..... 264/121

[56] References Cited

U.S. PATENT DOCUMENTS

| | | | |
|---|---|---|---|
| 3,028,287 | 4/1962 | Greten | 264/121 |
| 3,906,064 | 9/1975 | Iannazzi et al. | 264/121 |

*Primary Examiner*—Donald E. Czaja
*Assistant Examiner*—James R. Hall
*Attorney, Agent, or Firm*—Lackenbach, Lilling & Siegel

[57] ABSTRACT

A method for producing fibrous sheet material comprising dispersing fibers in a gas stream to obtain a gas-fiber stream, supplying the gas-fiber stream onto a flat screen, removing gas from the gas-fiber stream through said screen to form a fibrous layer thereon, removing part of the gas from the gas-fiber stream prior to supplying it onto the flat screen, simultaneously damping transversal pulsations induced in the gas-fiber stream during the course of its movement. The fiber concentration is increased to 20–500 g/m$^3$. The fiber concentration is chosen in accordance with the specific fiber and its properties. An apparatus for carrying out this method comprises a slot nozzle having side walls normal to converging frontal walls, its inlet opening communicating with means for dispersing fibers in a gas stream, while its outlet opening communicates with a chamber. A flat screen adapted to form a fibrous layer thereon is mounted under the chamber, and a suction box is arranged underneath the flat screen, wherein the side walls of the slot nozzle are parallel with respect to each other, and means for removing part of the gas from the gas-fiber stream are provided in the chamber under the outlet opening of the slot nozzle, the chamber being provided with branch pipes for gas exhaust, mounted substantially in the upper portion of the chamber.

5 Claims, 2 Drawing Figures

METHOD FOR PRODUCTION OF FIBROUS SHEET MATERIAL AND APPARATUS FOR CARRYING OUT THE SAME

FIELD OF THE INVENTION

The present invention relates to a method for the processing of fibers, sheet materials.

The present invention can most advantageously be employed in the pulp-and-paper, textile and construction-material industries for producing various kinds of paper, board, non-woven fabric, felt, and construction board.

BACKGROUND OF THE INVENTION

In order to product a fibrous sheet material it is essential to obtain a uniform distribution of fibrous material in a gas stream with a predetermined dispersity, and to maintain this dispersity along the entire flow path of the gas-fiber stream.

The gas-fiber stream must possess specific fluidity enabling its shape to be transformed to a flat stream, as well as an internal structure capable of achieving a homogeneous gas-fiber distribution throughout the stream.

The dispersity value of the air-fiber stream is assumed to be a ratio of the volume of discrete fibers or small fibrous aggregates to the volume of an individual fiber of mode-length, i.e. the length which predominates in the fiber length distribution.

The homogeneous fiber distribution in the air stream assumes the fiber concentration in each individual stream volume to have little or no fluctuation.

The dispersity value of the air-fiber stream and the homogeneous fiber distribution throughout the stream determines the degree of uniformity and structural homogeneity of the obtained fiber sheet material, while the degree of the fiber concentration in the air stream determines the amount of gas to be removed from the air-fiber mixture to form a layer of fibrous material on a flat screen.

The dispersity value of the air-fiber suspension is reduced by high autoadhesion of the fibers, i.e. clustering of separate fibers takes place. To decrease the likelihood of fiber collision causing clustering due to turbulent forces induced in the moving air-fiber stream, the fiber concentration must be low. Generally, the fiber concentration should be in the range from 5 to 30 g/m$^3$ depending upon the properties of the material produced and the kind of fiber.

Moreover, high fiber concentration in the air-fiber stream decreases the stream fluidity, and fluidity is a prerequisite for transforming the outer shape of the air-fiber stream, e.g. a cylindrical shape into a flat one, as well as for changing the internal structure of the air-fiber stream to attain uniform distribution of the velocity field in the stream cross-section, this being necessary for forming a uniform layer of fibrous material on a flat screen.

Thus, low fiber concentration of the gas-fiber stream is a necessary prerequisite for forming a fibrous sheet material. Therefore, if a layer of fibrous material is being formed with a high velocity, e.g. on the flat screen traveling at a velocity ranging from 180 to 900 m/min, a considerable amount of gas is to be removed from the gas-fiber mixture.

The flat screen with fibers settled thereon to form a layer of fibrous material has a high resistance coefficient value of from 20 to 500, depending on the kind of fiber and on the fibrous layer thickness. Therefore, the removal of a large amount of gas per unit of time, required in high-speed manufacturing of the fibrous layer, leads to increased electric power consumption.

The power expended in overcoming the resistance can be reduced with an adequate increase in an active area of the flat screen. This leads, however, to an objectionable increase in the size of the equipment.

The power consumed in overcoming the resistance developed on the screen during a layer forming process, when gas is being removed through the screen and fibrous layer precipitated thereon, can be reduced by increasing the concentration of fibers in the gas-fiber stream. In this case the gas-fiber stream must be expanded before it is supplied onto the screen in order to achieve a uniform distribution of the velocity field, a homogeneous distribution of fibers over an entire stream volume, and an increase in the dispersity value of the gas-fiber stream, all this making it possible to obtain a layer of fibrous material of homogeneous structure.

Known in the art is a method for producing fibrous sheet material (cf. U.S. Pat. No. 2,689,985). According to this method the fibrous material is finely divided and is delivered into the expanding gas stream to be transformed therein by mechanical intermixing, whereby a uniform distribution of the velocity field is achieved and separation of large aggregates into small fibrous solids takes place. The gas-fiber mixture then precipitates on the screen to form a fibrous layer thereon.

A device for carrying out this method for producing fibrous sheet material comprises a disc mill to individualize the fibers, said mill being connected through a discharging pipe to a diffuser having diverging side and frontal walls, and a rotating roller arranged therein, the latter comprising teeth. The gas-fiber stream is transformed with mechanical agitation caused by the rotating roller, thus resulting in homogeneous fiber distribution throughout the entire volume of the gas-fiber stream. The gas-fiber stream is supplied from the diffuser onto a flat screen.

Mounted under the screen is a suction box for removing gas from the gas-fiber stream supplied onto the screen during the layer forming process.

The disadvantage of the above-mentioned method and apparatus is that because of local fiber flocculation caused by mechanical agitation, it enables the gas-fiber stream having a fiber concentration as low as 5 to 10 g/m$^3$ to be transformed. When a gas-fiber stream of higher concentration is used, homogeneous distribution of fibers throughout the entire volume of the stream is disturbed.

Furthermore, the gas-fiber stream supplied onto the flat screen has a low fiber concentration. This leads to increased electric power consumption to overcome the resistance developed on the flat screen during the fibrous layer forming process when large amounts of gas are being removed through the screen and fibrous layer settled thereon.

A gas-fiber stream of higher fiber concentration can be supplied onto the screen if the fibers are thoroughly dispersed in the gas before being supplied onto the flat screen.

Known in the art is another method for production of fibrous sheet material. In this process, the fibrous material is ground and is fed into the expanding gas stream. The obtained gas-fiber stream is thoroughly dispersed and then supplied onto the flat screen to form a fibrous layer thereon.

An apparatus for carrying out this process comprises a diffuser having diverging side walls, with its inlet opening communicating with a gas-fiber stream supply pipe-line, and its outlet opening is connected to a rectangular upright chamber. Several airfoils are arranged in the chamber with their planes parallel to the chamber side walls, with the upper portion of each body dispersed inside the diffuser.

When the gas-fiber stream impacts against the airfoil, thorough dispersion occurs due to resilient repulsion of the fibers against the convex surfaces of the airfoils whereby the gas-fiber stream is distributed uniformly edgewise over the rectangular chamber, and uniform distribution of the velocity field is attained.

The above-mentioned method for producing fibrous sheet material and the apparatus for carrying out the same, however, fail to transform a gas-fiber stream having fiber concentrations higher than 5 to 15 g/m$^3$. If a gas-fiber stream of higher fiber concentration is fed to airfoils, the power of the distribution field is insufficient to intermix the gas-fiber stream containing a large quantity of fibers per unit. As a result, a uniform velocity field distribution is not achieved in the transformed gas-fiber stream.

Moreover, the fiber concentration of the stream supplied onto the flat screen continues to be low, leading to an increased consumption of power to overcome the resistance developed on the flat screen during the fibrous layer forming process, since large amounts of gas must be removed through the screen and the fibrous layer precipitated thereon.

The gas-fiber stream can be transformed, simultaneously using the multiple fiber dispersion effect and transversal pulsations induced in the gas-fiber stream.

Known in the art is another method for producing fibrous sheet material. In this process, fibers are dispersed in a gas stream to obtain a gas-fiber stream, which is distributed in a flattened form. The flattened gas-fiber stream is transformed by supplying it to a cylinder element.

The interaction of the flattened gas-fiber stream with the cylinder causes thorough fiber dispersion resulting from the resilient impingement of fibrous solids against the cylinder surface. Thus fiber solid shredding, i.e. increasing of the dispersion value, takes place.

The cylinder, scheduled in the apparatus, provides for transversal pulsations in the gas-fiber stream flowing over the cylinder, thus resulting in uniform distribution of the stream velocity field. The transformed gas-fiber stream is then supplied onto the flat screen to form a fibrous layer thereon. The fibrous layer is subjected to subsequent treatment to obtain a finished sheet material.

A device for carrying out the above-mentioned process for producing fibrous sheet material comprises an elongated slot nozzle having mutually perpendicular diverging side walls and converging frontal walls, the inlet opening of said nozzle communicating with means for dispersing fibers in a gas stream to obtain a gas-fiber mixture, while its outlet opening communicates with a chamber.

Arranged underneath the elongated nozzle, along its entire length, is a cylinder with its ends affixed to the side walls of the chamber. A special lattice for eliminating stream turbulence is placed downstream from the cylinder and spans the chamber cross-section.

The layer forming process takes place on a flat screen with the help of a suction box disposed under the chamber.

The disadvantages of the aforesaid method for producing fibrous sheet material and the apparatus for carrying out said method are that this apparatus can transform the gas-fiber stream having a fiber concentration of only 10 to 30 g/m$^3$. When the gas-fiber stream is delivered onto the cylinder, transversal pulsations in the gas-fiber stream flowing past the cylinder are generated, with the power of said pulsations gradually decreasing as the stream moves away from the cylinder. Therefore, when a gas-fiber stream of higher fiber concentration is fed to the cylinder, the power of the distribution fields and the transversal pulsations are insufficient for transforming the stream and for obtaining a sheet material homogeneous in structure.

None of the stream transforming apparatus can provide the desired degree of transforming a stream having a high fiber concentration.

Consequently, only a gas-fiber stream having low fiber concentration can be supplied on the flat screen in order to produce sheet material homogeneous in structure. This results in increased power consumption, since a great amount of gas must be removed per unit of time during the layer forming process.

SUMMARY OF THE INVENTION

It is an object of the present invention to provide a method for producing fibrous sheet material and an apparatus for carrying out same, to transform a gas-fiber stream to obtain on a flat screen a fibrous layer homogeneous in structure, the gas-fiber stream being of high concentration.

Another object of the present invention is to provide a process for producing fibrous sheet material homogeneous in structure, characterized by increased production output.

Still another object of the present invention is to reduce energy costs by virtue of reducing the amount of gas to be removed per unit time during the fibrous layer forming process.

Another object of the present invention is to reduce the size of the apparatus and amount of material necessary to construct it.

With these and other objects in mind there is provided a method for producing fibrous sheet material, comprising dispersing fibers in a gas stream to obtain a gas-fiber stream, supplying the gas-fiber stream onto a flat screen, removing gas from the gas-fiber stream through said screen to form a fibrous layer thereon, and its subsequent treating to obtain a fibrous sheet material. According to the invention, part of the gas is removed from the gas-fiber stream prior to supplying it onto the flat screen to bring the fiber concentration in the gas-fiber stream to 20 to 500 g/m$^3$, said concentration being chosen in accordance with the kind and properties of fibers. Transversal pulsations induced in the gas-fiber stream during the course of its movement, are damped.

The gas-fiber stream is transformed so that its fiber concentration increases from 5.0–50 g/m$^3$ to 20–500 g/m$^3$. This occurs due to the existence of fiber motion with respect to the gas, so that the fibers approach each other in a regular manner, resulting in an increase in local fiber concentration. Owing to this, a portion of fiber-free gas may be removed from the main body of a gas saturated with fibers.

The damping of transversal pulsations induced in the gas-fiber stream during the course of its movement is achieved by eliminating local flocculation occurring in the gas-fiber stream as the fiber concentration increases. This enables a sheet material of homogeneous structure to be obtained.

It is advisable to maintain the amount of gas being removed from the gas-fiber stream, prior to supplying it onto the flat screen, in a range of from 20 to 90 percent.

It is also desirable to damp the transversal pulsations by contracting the gas-fiber stream in a direction normal to the path of the stream's movement.

The contracting of the gas-fiber stream in the direction normal to the path of the stream provides for random flow of the stream with uniform distribution of the velocity field profile. This contributes to uniform fiber concentration and reduction of cross-stream turbulence.

With these and other objects in mind, there is also provided an apparatus for carrying out the method for producing fibrous sheet material, comprising a slot nozzle having side walls normal to converging frontal walls, an inlet opening of said nozzle communicating with a means for dispersing fibers in a gas stream an outlet opening communicating with a chamber, a flat screen adapted to form a fibrous layer thereon, mounted under said chamber, and a suction box arranged under the flat screen, wherein, according to the invention, the side walls of the slot nozzle are in parallel relationship with respect to each other, means for removing part of the gas from the gas-fibre stream is arranged within the chamber under the outlet opening of the slot nozzle, and the chamber is provided with branch pipes for exhaust gas, mounted substantially in the upper portion of the chamber.

The parallel arrangement of the side walls of the slot nozzle eliminates any considerable elongation of the velocity field profile, i.e. provides for uniform distribution of the velocity field profile.

Owing to the provision of means for removing part of the gas from the gas-fiber stream, disposed under the outlet opening of the slot nozzle, gas removal through the branch pipes arranged in the upper portion of the chamber is achieved, whereby fiber concentration of the stream increases, while power consumption during the fibrous layer forming process is reduced.

According to one embodiment of the invention, means for removing part of the gas from the gas-fiber stream is embodied as a plurality of guiding bodies arranged in parallel, one under the other and spaced 3 to 20 mm apart, to form a vertical row disposed under one of the frontal walls of the slot nozzle and inclined at 3.5° to 11° relative to the axis of the slot nozzle, each of the guiding bodies being inclined with respect to the axis of the slot nozzle at an angle ranging between 20° and 35° in the direction of the gas-fiber stream movement.

The means for removing part of the gas from the gas-fiber stream is a plurality of guiding bodies arranged in parallel, one under the other to form a vertical row disposed under one of the frontal walls of the slot nozzle, inclined at a particular angle with respect to the axis of the slot nozzle. This arrangement develops resistance to the gas-fiber stream leaving the outlet opening of the slot nozzle, whereby part of the gas changes its initial direction and is gradually removed when passing through gaps between the guiding bodies as the gas-fiber stream flows along the row of guiding bodies.

Due to the provision of gradual removal of gas through the gaps between the guiding bodies, fiber concentration of the stream increased, contributing to uniform distribution of the velocity field profile of the gas-fiber stream.

Owing to the inclination of the row of the guiding bodies with respect to the axis of the slot nozzle, the gas-fiber stream contracts as it flows along the guiding bodies, thereby increasing its homogeneity.

According to another embodiment of the invention, the means for removing part of the gas from the gas-fiber stream is a plurality of guiding bodies arranged in parallel one under the other and spaced 3 to 20 mm apart to form two vertical rows, each disposed under one frontal wall of the slot nozzle and inclined at 3.5° to 11° with respect to the axis of the slot nozzle, each of said guiding bodies being inclined relative to the axis of the slot nozzle at an angle ranging between 10° and 35° in the direction of movement of the gas-fiber stream, the guiding bodies of one row being in a mirror image position with respect to the guiding bodies of the other row.

A design of this type, enables the length of an active zone through which gas is removed, to be doubled, thus enabling reduction of the size of the unit, while maintaining production output at the same level.

Due to the converged position of the guiding bodies, contracting of the gas-fiber stream is effected in the direction normal to the direction of its movement, whereby transversal pulsations are partially damped.

It is advisable to make the guiding bodies in the form of blades.

Owing to the blade form of the guiding bodies, fiber loss from the gas-fiber stream is prevented when part of the gas is being removed.

It is advisable to arrange the guiding bodies of each row to form at least two groups of blades and to provide equal gaps between the guiding bodies in each group, the gaps between the guiding bodies of the upstream group being greater than the gaps between the guiding bodies of the downstream group.

By providing two groups of guiding bodies in each row, wherein the guiding bodies in each group are equally spaced with respect to each other and the gaps between the guiding bodies of the upstream group being greater than the gaps between the guiding bodies of the downstream group, removal of part of gas without fiber loss is ensured as the gas-fiber stream flows along the row of guiding bodies.

The gap between the guiding bodies of the upstream group should not exceed 20 mm, while the gap between the guiding bodies of the downstream group should not be less than 3 mm.

BRIEF DESCRIPTION OF THE DRAWINGS

Other objects, advantages and features of the invention will become apparent from the following detailed description of the invention and the accompanying drawings, in which.

Figure 1:
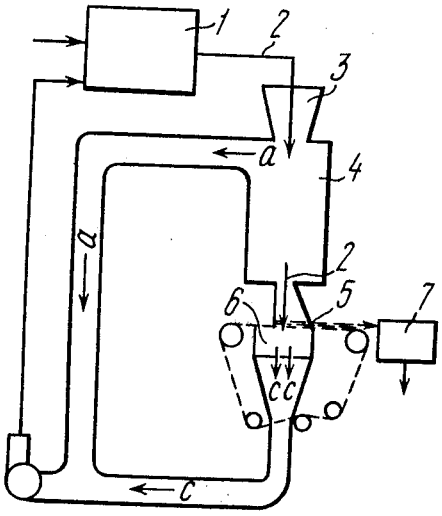
FIG. 1 is a simplified flow diagram illustrating the method for producing fibrous sheet material, according to the present invention.

Different part numbers of the several different figures which have equivalent functions have been identified with similar reference numerals distinguished by prime markings to indicate they are actually different parts. For example, part numbers 1, 1', and 1'' in FIGS. 1, 2, and 6, respectively, are each different means for dispersing fibers in a gas stream.

Figure 2:
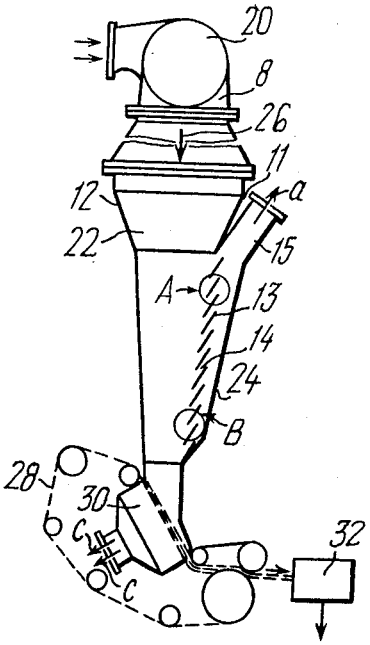
FIG. 2 is a diagrammatic general view of an apparatus which utilizes the method for producing fibrous sheet material, according to the invention.
Figure 5:
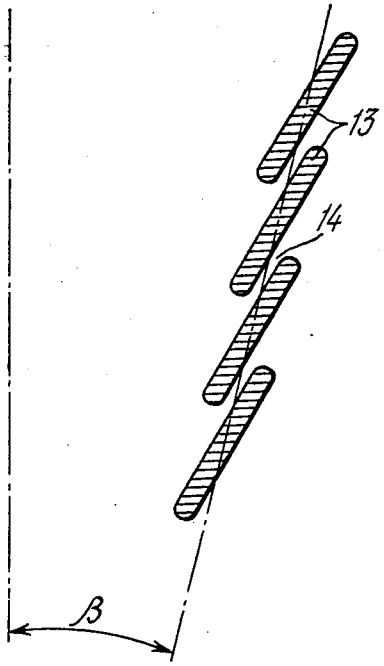
FIG. 5 is an enlarged view of the assembly B shown in FIG. 2.
Figure 4:
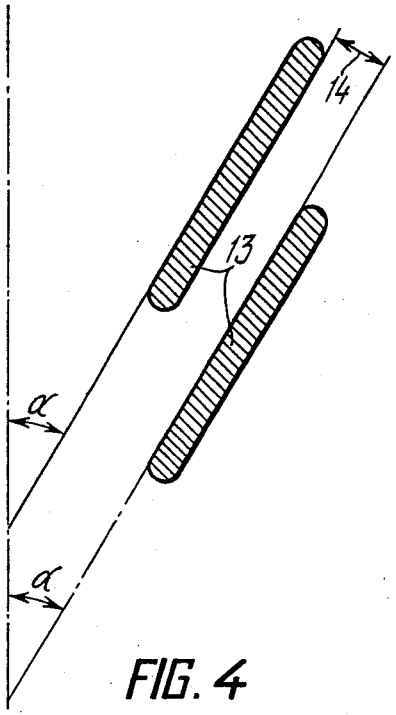
FIG. 4 is an enlarged view of the assembly A shown in FIG. 2.

A method for producing fibrous sheet material is illustrated by a flow diagram shown in FIG. 1.

Fibrous material and gas are supplied to a means 1 for dispersing fibers in a gas stream, whereby a gas-fiber stream 2 is obtained. The gas-fiber stream 2 is delivered through a slot nozzle 3 into a chamber 4. Within the chamber 4 the gas-fiber stream 2 is contracted, and due to inertial forces, relative motion of the gas and fibers is developed. When the gas-fiber stream is contracted, the gas and fibers move in different directions due to the fact that the density of fibrous material is 800 times more than that of the gas. The fibers travel along a path coinciding with the initial path of the gas-fiber stream 2, while a part of gas, free of fibers, starts to move in a direction opposite to the initial direction of the gas-fiber stream 2. As part of the gas is removed, the fiber concentration of the stream increases.

The flow path of that part of gas, which has changed its direction of movement is shown by the arrows "a".

The gas-fiber stream 2 is contracted in a direction normal to the direction of its movement, whereby transversal pulsations induced in the gas-fiber stream are gradually damped. Thus a uniform velocity field profile of fibrous material in the gas-fiber stream, as well as small-scale turbulence is achieved. This, in turn ensures high fiber concentration and, at the same time, homogeneity of the gas-fiber stream passing through the chamber 4.

The gas-fiber stream 2 is further delivered from the chamber 4 onto a flat screen 5, the remaining part of gas being removed therefrom by a suction box 6 mounted under the flat screen 5.

The direction of the part of gas removed from the gas-fiber stream 2 when it contacts the flat screen 5 is indicated by the arrows "c". A fibrous layer settled on the flat screen 5 is then fed to a means 7 where it is subjected to special treatment to obtain a finished fibrous sheet material.

The part of gas removed from the gas-fiber stream 2 in the chamber 4, and that removed from the flat screen 5 may be reused by supplying them into the means 1 for dispersing fibers without any additional cleaning of fibers from gas, since the fiber content in the gas is of 0.02 to 0.5 g/m$^3$. The fibers may be reused as well.

Thus the problem of environment protection is efficiently solved.

20 to 90 percent of the gas is removed from the gas-fiber stream 2 in the chamber 4.

The amount of gas removed from the gas-fiber stream 2 is chosen in accordance with a desired mass of 1 square meter of the finished material and with the length of fibers fed into the dispersing means 1.

In order to provide mobility to fibers having a length from 0.5 to 38 mm when fibrous sheet material with a high degree of structural homogeneity, having a mass of 12 to 40 g/m$^2$, is to be obtained, 20 to 40% of the gas is removed.

From 40 to 60 percent of gas is to be removed from the gas-fiber stream 2 where lower mobility, of fibers having a length from 0.5 to 38 mm, is possible when homogeneous fibrous sheet material having a mass of 40 to 100 g/m$^2$is to be formed.

From 60 to 90 percent of gas is to be removed from the gas-fiber stream 2 where still lower mobility of the fibers in the gas-fiber stream 2, is possible, to produce homogeneous fibrous sheet material whose mass per square meter is more than 100 g.

If the amount of gas being removed is under 20 percent, the process does not justify the expenditure of current, the latter drastically increasing because of the considerable volume of gas to be removed per unit of time.

It almost impossible to remove more than 90 percent of gas from the gas-fiber stream 2.

Figure 3:
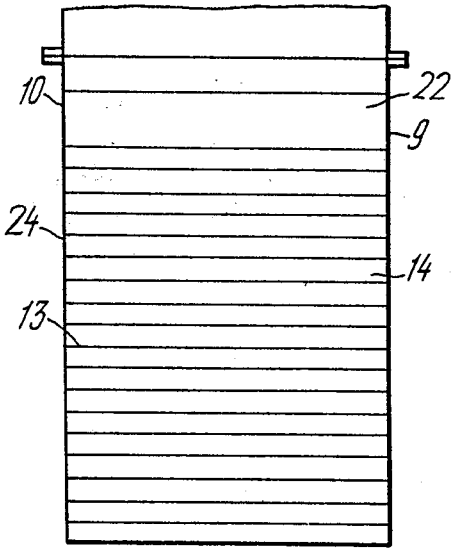
FIG. 3 is a partial longitudinal section of FIG. 2.

An apparatus for carrying out the method for producing fibrous sheet material comprises a pipe 8 (FIG. 2) interconnecting the means 20 for dispersing fibers in a gas stream and an inlet opening of the slot nozzle 22. The slot nozzle 22 has parallel side walls 9, 10 (FIG. 3) which are normal to the converging frontal walls 11, 12. An outlet opening of the slot nozzle 22 communicates with the chamber 24.

Installed within the chamber 24 under the frontal wall 11 of the slot nozzle 22 are guiding bodies represented by blades 13 (FIGS. 2–5). The blades are disposed in a spaced parallel relationship one under the other, a gap 14 therebetween ranging from 20 to 3 mm.

The gap 14 between the blades 13 is chosen in accordance with the length of fibers used in a layer forming process. If the fiber length is 2 mm and under, the gap 14 is chosen from 10 to 3 mm, for the fiber length equal to 20–35 mm the gap 14 is in the range between 10 and 20 mm. The blades 13 are inclined at an acute angle $\alpha$ with respect to the axis of the slot nozzle 22 in the direction of the stream movement.

The angle $\alpha$ is chosen in accordance with the mass of fibrous material and with the elasticity of the fibers. In case the fibers possess adequate elasticity and the fibrous material mass is sufficient, considerable inertial forces are generated in the gas-fiber stream 26 as it moves along the blades 13. To prevent the gas-fiber stream 26 from fiber loss occurring through the gaps 14 between the blades 13, the angle $\alpha$ is set close to 35°. Owing to this, the fibers impinge against the blade surfaces toward the axis of the chamber 24. Moreover, such an angle $\alpha$ provides additional resistance to the blades 13 to the gas-fiber stream 26, resulting in an intensification of the process of removing part of the gas from the gas-fiber stream 26.

When the fibers possess low elasticity and small mass, reduced inertial forces are developed in the gas-fiber stream 26 as it moves along the blades 13. The angle $\alpha$ is set close to 10° to provide smooth movement of fibers not possessing adequate elasticity to be repelled from the blade surfaces, along the blades 13. Moreover, such an angle $\alpha$ imparts negligible additional resistance to the blades to the gas-fiber stream 26, thus eliminating fiber loss when the gas is being removed.

The blades 13 are fixed with their end faces to the side walls 9, 10 (FIG. 3) of the chamber 24, the length of each blade being equal to the distance between the side walls 9 and 10 of the chamber 24.

The blades 13 form a vertical row inclined with respect to the axis of the slot nozzle 22 at an angle $\beta$ (FIG. 5) chosen within the limits ranging from 3.5° to 11°.

The largest angle $\beta$ occurs if a sharp increase of blade resistance to the gas-fiber stream 26 must be created in order to intensify the removal of gas. High intensity gas removal from the gas-fiber stream 26 may be effected only when the mass of every elementary fiber is significant, e.g. when fibers having considerable length or density, such as asbestos fibers are used. In this case inertial forces acting upon the fibers in the gas fiber stream 26 are great, whereby the fiber loss with the gas being removed in negligible.

Setting the row of blades at an angle $\beta$ greater than 11° leads to an unduly intensive removal of gas resulting in appreciable fiber loss accompanying removal of gas.

If the fibers are short or possess low density, e.g. hollow fibers, inertial forces acting thereon, are significant. In this case intensive gas removal is unnecessary, since a great amount of fibrous material will be lost. Therefore, the gas removing process is performed with lower intensity, i.e. low resistance to the gas-fiber stream 26. The need for satisfying these requirements dictates that the angle $\beta$ be close to 3.5°.

Connected to the upper portion of the chamber 24 (FIG. 2) is a branch pipe 15. The flat screen 28 is found under the chamber 24. The suction box 30 is disposed underneath the flat screen 28. A fibrous layer formed on the flat screen 28 is then fed to a means 32 where it is subjected to later treatment to obtain a finished sheet material.

Figure 6:
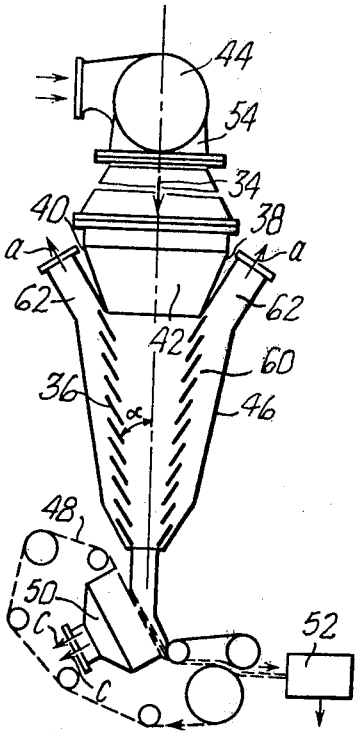
FIG. 6 is a view of an alternative form of apparatus for carrying out the method for producing fibrous sheet material, according to the invention.
Figure 7:
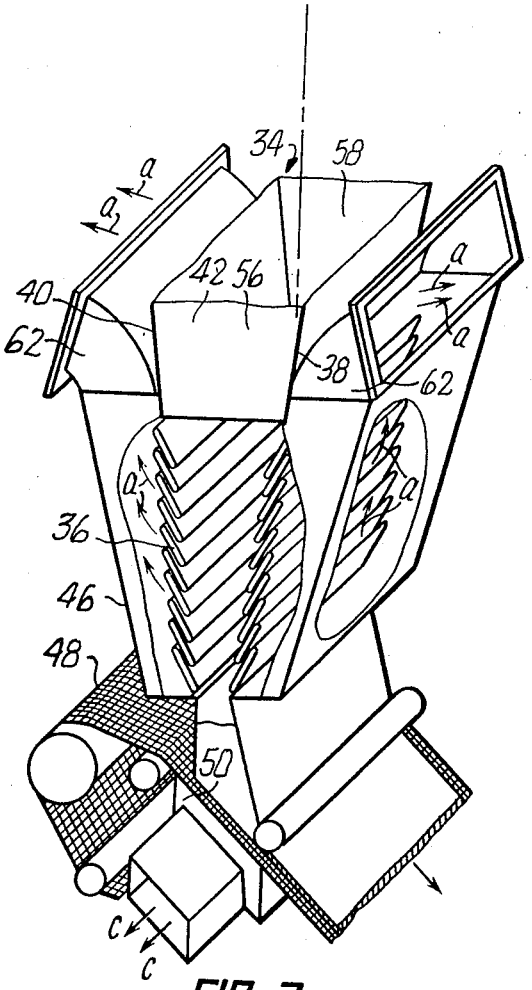
FIG. 7 is a perspective view of the apparatus shown in FIG. 6.

FIGS. 6, 7 show another embodiment of an apparatus for production of fibrous sheet material, wherein a means for removing a part of gas from the gas-fiber stream 34 is a plurality of blades 36 disposed to form two vertical rows, each being located under one of the frontal walls 38 and 40 of the slot nozzle 42 and inclined relative to the axis of said slot nozzle 42 at an angle ranging from 3.5° to 11°.

The blades 36 forming a row disposed under the frontal wall 38 are positioned in mirror image fashion with respect to the blades 36 forming a row disposed under the frontal wall 40 of the slot nozzle 42. The blades 36 in each row are mounted in parallel one under the other and are spaced 3 to 20 mm apart, each blade 36 being inclined relative to the axis of the slot nozzle 42 at an angle 10°–35° in the direction of the stream movement.

Figure 9:
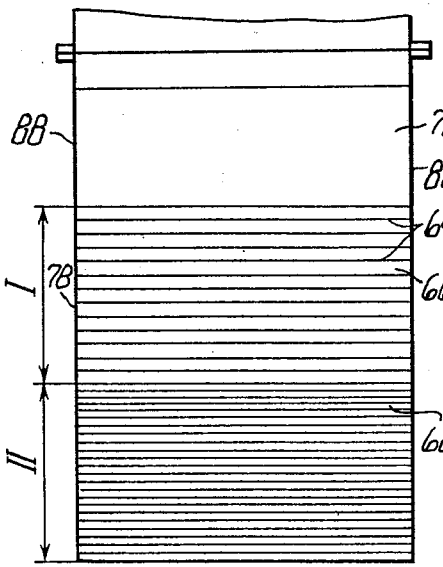
FIG. 9 is a partial longitudinal section of FIG. 8.
Figure 8:
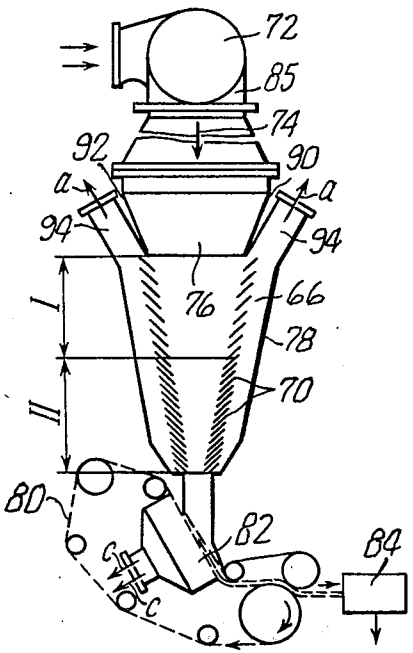
FIG. 8 shown another embodiment of an apparatus for carrying out the method of the present invention for producing fibrous sheet material.

FIGS. 8, 9 show still another embodiment of an apparatus for production of fibrous sheet material, wherein each row of the blades 64 is divided into two sections I and II. The section I is positioned above the section II. The gap 66 between the blades 64 of the section I is set from 20 to 10 mm, while the gap 68 between the blades 70 of the section II is set from 10 to 3mm. Part 72 is a fiber dispersing means; 74 is a gas-fiber stream; 76 is a slot nozzle; 78 is a chamber; 80 is a flat screen; 82 is a suction box; 84 is a means for obtaining finished fibrous sheet material; 85 is a pipe; 86 and 88 are parallel side walls; 90 and 92 are frontal walls; and 94 is a branch pipe. All of the aforenamed parts have functions similar to that of correspondingly named parts in FIGS. 1–7.

Figure 10:
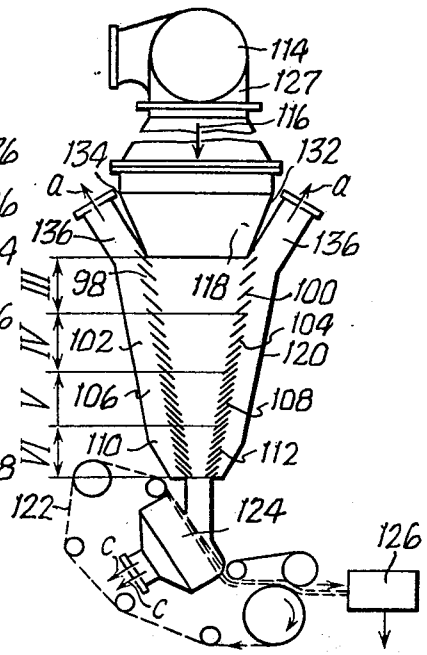
FIG. 10 shows still another embodiment of an apparatus for carrying out the method of the present invention for production of fibrous sheet material.

FIG. 10 illustrates a still further embodiment of an apparatus for production of fibrous sheet material, wherein each row of the blades is divided into four sections III, IV, V, VI. The gap 98 between the blades 100 over the section III is set within 20 to 17 mm, the gap 102 between the blades 104 over the section IV is set from 16 to 12 mm, the gap 106 between the blades 108 over the section V is set from 11 to 6 mm, and the gap 110 between the blades 112 over the section VI is set from 6 to 3 mm. Part number 114 is a fiber dispersing means; 116 is a gas-fiber stream; 118 is a slot nozzle; 120 is a chamber; 122 is a flat screen; 124 is a suction box; 126 is a means for obtaining finished fibrous sheet material; 127 is a pipe; 128 and 130 are parallel side walls; 132 and 134 are frontal walls; and 136 is a branch pipe. All of the aforementioned parts also have functions similar to that of correspondingly named parts in FIGS. 1–7.

The following considerations were taken into account when setting the gap distance between the blades in each section. When the gas-fiber stream 74 enters the zone of section I (FIG. 8), fiber concentration in the gas-fiber stream is low and the resistance offered by fibrous material to the transversal flow of gas during its removal is also low. Moreover, due to high mobility of fibers resulting from low fiber concentration over the section I, the inertia of each fiber particle shows itself up more clearly than over the subsequent sections. Owing to that, more intensive removal of gas is ensured in the zone of section I, and a large gap distance between the blades 64 may be provided practically without any fiber loss. The fiber concentration of the gas-fiber stream 74 increases as it passes through the zone of the section I and enters the zone of the section II.

The resistance of the transversal gas flow rises over the section II because of an increased fiber concentration. The same is responsible for the low mobility of fibers, said mobility occurring due to the action of inertial forces. Thus, the probability of fiber loss with gas being removed, increases.

The gap distance 68 between the blades 70 in the section II, however, is small, whereby the gas removal velocity becomes lower and the fiber loss is reduced.

Thus, by varying the gap distances 66 and 68 between the blades 64 and 70, respectively, in each section, gas bleeding is controlled over the entire length of the row of the blades.

The apparatus for producing fibrous sheet material operates as follows. The fibers are supplied to the fiber dispersing means 44 (FIG. 6). The obtained gas-fiber stream 34 is fed through the pipe 54 to the inlet opening of the slot nozzle 42. Due to the provision of converging frontal walls 38 and 40 and parallel side walls 56 and 58 (FIG. 7), the cross-sectional area of the slot nozzle 42 is reduced, whereby the velocity of the gas-fiber stream 34 increases as it leaves the slot nozzle 42. At the same time the gas-fiber stream 34 is contracted, thereby resulting in uniform distribution of its velocity field.

Upon leaving the slot nozzle 42 (FIG. 6) the gas-fiber stream 34 encounters resistance from the converging rows of blades 36. As a result, a considerable part of the gas changes its direction of flow and, is directed into the gaps 60 between the blades 36, enters the chamber 46 and is removed from the apparatus through the pipe branches 62.

The density of the fibers being much greater than that of the air, the fibers, under the action of inertial forces continue their rectilinear movement between the converging rows of the blades 36. Part of fibers impinge against the blade surfaces and, being repelled therefrom due to blade orientation at a certain angle relative to the axis of the slot nozzle 42, move towards the central part of the cavity formed by two converging rows of the blades 36.

As the gas is being gradually removed through the gaps 60, between the blades 36, the fiber concentration of the gas-fiber stream 34 increases.

The converged position of the rows of the blades 36, provide for contracting the gas-fiber stream 34, and increases the degree of homogeneity of the stream.

A high fiber concentration of the gas-fiber stream 34 decreases the fiber mobility.

Upon passing between the rows of the blades 36, the gas-fiber stream 34 is transformed to meet the requirements imposed thereupon to obtain fibrous sheet material of homogeneous structure, and is supplied onto the moving flat screen 48.

As the gas-fiber stream 34 contacts the flat screen 48, the remaining part of gas is removed by means of the suction box 50, the fibers are deposited on the flat screen 48 to form a homogeneous fibrous layer. The obtained layer is then fed to the means 52 for obtaining finished fibrous sheet material, where a homogeneous fibrous sheet material is produced.

EXAMPLE 1

Sheet material having a mass of 105 g/m$^2$ is to be produced from asbestos fibers of 2.5 mm mode-length.

| | | |
|---|---|---|
| (a) | fiber concentration in the gas-fiber stream | 50 g/m$^3$; |
| (b) | velocity of the gas-fiber stream | 10 m/s; |
| (c) | cross-stream component of gas-fiber stream turbulence intensity | 20%; |
| (d) | air is used as a gas medium; | |
| (e) | amount of gas to be removed ranges from 80% to 90%, since a fibrous material of 105 g/m$^2$ *is to obtained from short fibers.* | |

The means for removing part of the gas from the gas-fiber stream is embodied as a plurality of blades forming two vertical rows, each row being disposed under one frontal wall of the slot nozzle. Each blade is inclined relative to the axis of the slot nozzle at 10°, and each row of blades is inclined relative to the axis of the slot nozzle at 11°.

The above-mentioned minimum angle of blade inclination and maximum angle of row inclination with respect to the slot nozzle axis is chosen in order to provide an intensive removal of gas from the gas-fiber stream as the latter is moving between the rows of blades.

Each row of blades is divided in four sections. The first three sections, as viewed from the nozzle, are of the same length. The length of the fourth section is equal to 1.2 times the length of the first section. The gap between the blades over the first section is equal to 12 mm, the gap between the blades over the second section is equal to 8 mm, the gap between the blades over the third section is equal to 6 mm, and the gap between the blades over the fourth section is equal to 3 mm.

Due to the provision of four sections, each having a different gap between the blades, a smooth removal of gas from the gas-fiber stream is ensured. The loss of asbestos fibers including a considerable small-sized fraction, is insignificant. Though the length of asbestos fibers is small, its mass is great, therefore, the gap between the blades over the first section may be set much greater than the fiber length. In this case considerable inertial forces are developed in the gas-fiber stream as it moves along the blades of the first section, and these forces prevent fiber loss.

The gas-fiber stream is supplied to the slot nozzle at a velocity of 10 m/s. Upon leaving the slot nozzle, its velocity increases up to 15 m/s due to the provision of converging frontal walls. As the gas-fiber stream travels between the rows of blades, the gas is partially removed therefrom, 50 percent of gas being removed over the first section, 30 percent over the second section, 15 percent over the third section, and 5 percent over the fourth section. The total amount of gas partially removed from the gas-fiber stream is taken as 100 percent. The gas removed from the gas-fiber stream is delivered from the chamber through branch pipes to the means for dispersing fibers in a gas stream. The total fiber loss does not exceed 10 percent.

As a result of removing from 80 to 90 percent of the gas, the fiber concentration in the gas-fiber stream is increased to 250–500 g/m$^3$, while the transversal pulsations characterized by the cross-stream component of gas-fiber stream turbulence intensity, fall to 5–8 percent, thereby enabling a gas-fiber stream of homogeneous structure to be obtained.

The gas-fiber stream moving with a velocity of 15 m/s is further supplied onto the flat screen traveling at the same velocity. The remainder of the gas ranging between 10 and 20 percent is removed by means of a suction box, thus forming a fibrous layer on the flat screen having a mass of 70 g/m$^2$. The fibrous layer is then subjected to impregnation with 3% silicon emulsion to obtain a material having a mass of 105 g/m$^2$, rolling and drying to achieve a humidity of 2 percent. The finished sheet material possesses a high thermal and electrical insulation properties and can be advantageously used in electrical engineering.

EXAMPLE 2

Sheet material having a mass of 110 g/m$^2$ is to be produced from sulfate bleached cellulose, having a fiber mode-length of 1.5 mm.

| | | |
|---|---|---|
| (a) | fiber concentration in the gas-fiber stream | 50 g/m$^3$; |
| (b) | as a gas medium air is used, containing 10 percent carbon dioxide addition to prevent explosion of the gas-fiber mixture under the action of static electric charges; | |
| (c) | velocity of the gas-fiber stream | 8 m/s; |
| (d) | cross-stream component of gas-fiber stream turbulence intensity | 25%. |

The amount of gas to be preremoved ranges between 60 and 80 percent, since a material having a mass of 110 g/m$^2$ is to be obtained.

The means for removing part of the gas from the gas-fiber stream is embodied as a plurality of blades forming two vertical rows, each row being disposed under one frontal wall of the slot nozzle. Each blade is inclined with respect to the axis of the slot nozzle at 10°, and each row of blades is inclined with respect to the axis of the slot nozzle at 3.5°.

The above-mentioned minimum angles of inclination of each blade and of the row of blades relative to the axis of the slot nozzle are chosen in order to provide an intensive removal of gas from the gas-fiber stream as the latter moves between the rows of blades.

Each row of blades is divided in three sections of the same length. The gap distance between the blades over the first section is equal to 11 mm, the gas distance between the blades over the second section is equal to 9 mm, and the gap distance between the blades of the third section is equal to 4 mm.

Cellulosic fibers have a lesser amount of small-size fractions than the asbestos fibers have, hence it is sufficient to divide the rows of blades into only three sections and to carry out the removal of gas less smoothly.

Blade-to-blade gap distances over each section ensure an intensive removal of gas without considerable fiber loss.

The gas-fiber stream is supplied to the slot nozzle at a velocity of 8 m/s. Upon leaving the slot nozzle, its velocity increases upo to 10 m/s. As the gas-fiber stream travels between the rows of blades, the gas is partially removed therefrom, 55 percent of the gas being removed over the first section, 30 percent of the gas being removed over the second section, and 7 percent of the gas being removed over the third section. The total amount of gas partially removed from the gas-fiber stream is taken as 100 percent.

As a result of removing 60 to 80 percent of the gas, the fiber concentration in the gas-fiber stream is increased to 125–250 g/m$^3$, while the transversal pulsations of the gas-fiber stream fall to 4–6 percent, thereby enabling a homogeneous gas-fiber stream to be obtained.

The gas-fiber stream moving with a speed of 10 m/s is further supplied onto the flat screen traveling with the same speed. The remaining part of gas ranging from 20 to 40 percent is removed by means of a suction box, thus forming on the flat screen a layer of cellulosic fibers, having a mass of 90 g/m$^2$. The fibrous layer is impregnated with a 3% solution of modified maize starch to increase the mass of the material up to 110 g/m$^2$, and then is subjected to rolling and drying, whereby a wrapping paper is obtained.

EXAMPLE 3

Sheet material having a mass of 40 g/m$^2$ is to be produced from viscose fibers, having fiber-mode length of 8 mm.

| | | |
|---|---|---|
| (a) | fiber concentration in the gas-fiber stream | 25 g/m$^3$; |
| (b) | air is used as a gas medium | |
| (c) | velocity of the gas-fiber stream | 6 m/s; |
| (d) | cross-stream component of gas-fiber stream turbulence intensity | 38%. |

The amount of gas to be preremoved ranges between 50 and 60 percent, since viscose fibers are long and since a material of 40 g/m$^2$ is to be obtained.

The means for removing a part of gas from the gas-fiber stream is embodied as a plurality of blades forming two vertical rows, each row being disposed under one of the frontal walls of the slot nozzle. Each blade is inclined relative to the axis of the slot nozzle at 15°, each row of blades being inclined relative to the axis of the slot nozzle at 7°.

Since the viscose fibers do not possess adequate resiliency, inclination of the blades with respect to the axis of the slot nozzle at 15° provides for smooth movement of the fibers along the blades, while an inclination of the row of blades relative to the axis of the slot nozzle at 7° ensures moderate intensity of gas removal from the gas-fiber stream.

Each row of blades is divided into two sections of the same length. The blade-to-blade gap distance over the first section is equal to 10 mm, the gap distance between the blades over the second section is equal to 5 mm.

The gas-fiber stream is supplied to the slot nozzle at a velocity increased up to 8 m/s. As the gas-fiber stream passes between the rows of blades, the gas is partially removed therefrom, 60 percent of the gas being removed over the first section, and 30 percent of the gas being removed over the second section. The total amount of gas preremoved from the gas-fiber stream is taken as 100 percent.

As a result of removing from 50 to 60 percent of the gas, the fiber concentration in the gas-fiber stream increases from 25 g/m$^3$ to 50–64 g/m$^3$, while the transversal pulsations of the gas-fiber stream decrease, due to contracting of the stream, to 7 percent, thus providing for homogeneous structure of the gas-fiber stream.

The gas-fiber stream moving with a speed of 8 m/s is supplied onto the flat screen traveling with the same speed. The remaining part of gas, ranging from 40 to 50 percent, is removed by means of a suction box, thus forming on a flat screen a layer of viscose fibers, having a mass of 30 g/m$^2$, which is then impregnated with 15% water-polyvinyl acetate dispersion to increase the mass of the finished material up to 40 g/m$^2$. The material is subjected to rolling and drying to produce a nonwoven oil filtering material for large diesel engines.

EXAMPLE 4

Sheet material having a mass of 20 g/m$^2$ is to be produced from polyester man-made fibers of 28 mm modelength.

| | | |
|---|---|---|
| (a) | fiber concentration in the gas-fiber stream | 8 g/m$^3$; |
| (b) | ionized air stream is used as a gas medium; | |
| (c) | velocity of the gas-fiber stream | 7 m/s; |
| (d) | cross-stream component of gas-fiber stream turbulence intensity | 35%. |

The amount of gas to be preremoved ranges from 20 to 25 percent, since a fibrous sheet material having a mass of 20 g/m$^2$ is to be produced.

The means for removing a part of gas from the gas-fiber stream is a plurality of blades forming one vertical row disposed under one of the frontal walls of the slot nozzle. The blade-to-blade gap distance is equal to 20 mm. Each blade is inclined relative to the axis of the slot nozzle at 35°, while the row of blades is inclined relative to the axis of the slot nozzle at 3.5°.

The above-mentioned angles of inclination of each blade and of the row of blades with respect to the axis of the slot nozzle are chosen to ensure removal of a small amount of gas essentially without fiber loss.

The gas-fiber stream is supplied to the slot nozzle at a velocity of 7 m/s. Upon leaving the slot nozzle, its velocity is as high as 10 m/s. As the gas-fiber stream travels along the blades, 20 percent of the gas is removed therefrom. As a result of removing 20 percent of the gas, fiber concentration in the gas-fiber stream increases from 16 g/m$^3$ to 21 g/m$^3$. The cross-stream component of the turbulence intensity decreases, due to contracting of the gas-fiber stream, to 12 percent.

The gas-fiber stream moving with a speed of 15 m/s is supplied onto the flat screen moving with the same speed. The remaining part of the gas, namely 80 percent, is removed from the gas-fiber stream by means of a suction box, thus forming a layer of man-made fibers, having a mass of 15 g/m$^2$. The layer is impregnated with a 5% solution of polyvinyl alcohol to obtain a material having a mass of 20 g/m$^2$, which is then subjected to rolling and drying. The finished material is a long grain paper suitable for use in electrical engineering.

EXAMPLE 5

Sheet material having a mass of 500 g/m$^2$ is to be produced from defibered wood fibrous particles.

| | | |
|---|---|---|
| (a) | fiber concentration of the gas-fiber stream | 50 g/m$^3$; |
| (b) | velocity of the gas-fiber stream | 8 m/s; |
| (c) | cross-stream component of the turbulence intensity | 32%; |
| (d) | air is used as a gas medium; | |
| (e) | an amount of gas to be removed ranges from 85 to 90 percent, since a fibrous material having a mass over 100 g/m$^2$ is to be produced. | |

The means for removing a part of gas from the gas-fiber stream is embodied as a plurality of blades arranged so as to form two vertical rows, each disposed under one of the frontal walls of the slot nozzle, each blade being inclined relative to the axis of the slot nozzle at 30°, while each row of blades is inclined relative to the axis of the slot nozzle at 11°.

The above-mentioned maximum angles of inclination of each blade and of each row relative to the axis of the slot nozzle are chosen in order to provide an intensive removal of gas from the gas-fiber stream as it flows between the rows of blades.

Wood fibrous particles used in the process possess great mass and considerable resilience, therefore inertial forces acting upon the fibrous material are significant.

For the same reason blade-to-blade gap distances have the same dimensions equal to 6 mm. The gas-fiber stream is fed to the slot nozzle at a velocity of 8 m/s. Upon leaving the slot nozzle the velocity of the gas-fiber stream increases up to 10 m/s.

As the stream of gas and wood fibrous particles flows between the rows of blades, 85–90 percent of the gas is removed. As a result, the concentration of wood fibrous particles is increased to 334–500 g/m$^3$. The cross-stream component of the turbulence intensity decreases, due to the contracting of the stream of gas and wood fibrous particles, to 7–10 percent.

The stream is further supplied onto the flat screen in a direction normal to its plane.

The flat screen travels at a velocity of 0.8 m/s. The remaining part of gas accounting for 10–15 percent, is removed from the gas-fiber stream by means of a suction box, thus forming a layer of wood fibrous particles, having a mass of 400 g/m$^3$. The obtained layer is impregnated with a solution of a phenolic resin to increase the mass of finished material to 500 g/m$^3$. The material is then cut into sheets having dimensions 3×3 m and subjected to a pressure of 60 kg/cm$^2$ for 20 min. at 180° C.

The finished material is a fibrous construction board suitable in the construction material industry.

EXAMPLE 6

Woolen felt having a mass of 400 g/m$^2$ is to be produced from fibers of 10–35 mm mode-length.

| | | |
|---|---|---|
| (a) | fiber concentration in the gas-fiber stream | 40 g/m$^3$; |
| (b) | velocity of the gas-fiber stream | 6 mg/s; |
| (c) | cross-stream component of the turbulence intensity 40%; | |
| (d) | air is used as a gas medium; | |
| (e) | the amount of gas to be removed | 90%. |

The means for removing a part of gas is embodied as two rows of blades, each row being disposed under one of the frontal walls of the slot nozzle. The blades in each row are inclined at 18°, each row being inclined at 11°.

The above-mentioned angles of inclination of the elements are chosen with regard to the mass of elementary fibers and their resilience. Since the fibers are long and possess a considerable mass, an intensive removal of gas can occur. The resilience of the fibers is very high, therefore the angle of inclination of the blade is set at 18°.

Gap distances between the blades are the same and equal to 10 mm, since the mass of each fiber is sufficient to ensure, under the action of inertial forces, a high velocity transversal flow of gas being removed.

The stream of gas and woolen fibers is fed to the slot nozzle with a speed of 7 m/s. Upon leaving the slot nozzle the stream moves at a speed of 8.5 m/s and is channeled between two rows of blades. As the stream flows between two rows of blades, 88–90 percent of the gas is removed. The concentration of fibers in the gas-fiber stream is increased to 410–500 g/m$^3$. With a part of the gas removed, the gas-fiber stream is supplied onto the flat screen with a velocity of 8.5 m/s at 120° with respect to its plane. The flat screen moves at a velocity of 1.35 m/s, the remaining part of gas is removed by means of a suction box.

As a result, a layer of fibrous material having a mass of 400 g/m$^2$ is formed on the screen.

The obtained layer is subjected to rolling.

The finished material is a felt used in the textile and construction material industries.

While particular embodiments of the invention have been shown and described in detail, various modifications thereof will be apparent to those skilled in the art and therefore it is not intended that the invention be limited to the disclosed embodiments or to the details thereof and departures may be made therefrom within the spirit and scope of the invention as defined in the claims.

What is claimed is:

1. In a method for producing a fibrous sheet material comprising:

(a) dispersing fibers in a gas stream to form a gas-fiber stream;

(b) supplying the gas-fiber stream onto a screen whereon the fibers are deposited to form a fibrous layer thereon; and (c) treating the fibrous layer to produce a finished fibrous sheet material, the improvement which comprises:

(d) between steps (a) and (b), the gas-fiber stream is passed through a conduit having a plurality of guide means arranged in parallel converging rows with spaces between the guide means;

(e) said guide means being positioned at an acute angle with respect to the direction of movement of the gas-fiber stream so that the fibers in the gas-fiber stream impinge against the guide means, thereby contracting the flow of said gas-fiber stream and redirecting a portion of the gas, in said gas-fiber stream, to flow through the spaces between the guide means in a direction different than the initial direction of the gas-fiber stream, whereby the fiber concentration in the remaining gas-fiber stream is concentrated to 20 to 500 grams per cubic meter.

2. The method of claim 1, wherein the fibrous material is selected from the group consisting of asbestos, cellulose, viscose, polyester, wood, and wool.

3. The method of claim 1, wherein the removed gas portion is recycled to the initial fiber dispersing step (a).

4. The method of claim 1, wherein the amount of gas being removed from the gas-fiber stream between steps (a) and (b) is in the range between 20 and 90 percent.

5. The method of claim 1, wherein in step (e) the gas-fiber stream is contracted in a direction normal to the direction of flow of said stream.

* * * * *